US007287584B2

(12) United States Patent
Angman et al.

(10) Patent No.: US 7,287,584 B2
(45) Date of Patent: Oct. 30, 2007

(54) ANCHORING DEVICE FOR A WELLBORE TOOL

(75) Inventors: Per G. Angman, Calgary (CA); Maurice W. Slack, Edmonton (CA)

(73) Assignee: Tesco Corporation, Calgary (CA)

( * ) Notice: Subject to any disclaimer, the term of this patent is extended or adjusted under 35 U.S.C. 154(b) by 114 days.

(21) Appl. No.: 10/537,778

(22) PCT Filed: Dec. 8, 2003

(86) PCT No.: PCT/CA03/01889

§ 371 (c)(1),
(2), (4) Date: Jan. 10, 2006

(87) PCT Pub. No.: WO2004/053288

PCT Pub. Date: Jun. 24, 2004

(65) Prior Publication Data

US 2006/0102338 A1 May 18, 2006

(30) Foreign Application Priority Data

Oct. 9, 2003 (CA) ..... 2444648

(51) Int. Cl.
*E21B 17/14* (2006.01)

(52) U.S. Cl. ..... 166/177.4; 166/242.8

(58) Field of Classification Search ..... 166/54, 166/177.4, 319, 332.8
See application file for complete search history.

(56) References Cited

U.S. PATENT DOCUMENTS

| | | | |
|---|---|---|---|
| 1,350,553 | A | 8/1920 | Mack |
| 1,395,718 | A | 11/1921 | Mack |
| 1,949,498 | A | 3/1934 | Stone et al. |
| 2,114,373 | A | 4/1938 | Edwards |
| 2,179,017 | A | 11/1939 | Pieper |
| 2,313,178 | A | 3/1943 | Spang |
| 2,382,455 | A | 8/1945 | Turechek |
| 2,651,371 | A | 9/1953 | Toelke |
| 2,762,436 | A | 9/1956 | Brown |
| 3,006,415 | A | 10/1961 | Burns et al. |
| 3,087,551 | A | 4/1963 | Kerver |
| 3,159,219 | A | 12/1964 | Scott |
| 3,385,372 | A | 5/1968 | Knox |
| 3,768,556 | A | 10/1973 | Baker |

(Continued)

FOREIGN PATENT DOCUMENTS

| | | |
|---|---|---|
| WO | WO 01/94739 | 12/2001 |

(Continued)

OTHER PUBLICATIONS

Shepard S. F. et al, Casing Drilling: An Emerging Technology, Proceedings SPE/IADS Drilling Conference, XX, No. 67731, Feb. 27, 2001 XP002177809.

(Continued)

*Primary Examiner*—Frank Tsay
(74) *Attorney, Agent, or Firm*—Bennett Jones LLP

(57) ABSTRACT

An anchoring device for tool is disclosed that can be positioned downhole and used in casing. The anchoring device can have an architecture that supports installation by running downhole and into engagement with a recess formed in the casing. The anchoring device can support the use of weak materials such as plastic.

18 Claims, 9 Drawing Sheets

U.S. PATENT DOCUMENTS

| | | | |
|---|---|---|---|
| 3,860,067 | A | 1/1975 | Rodgers |
| 3,913,686 | A | 10/1975 | Manson, Jr. |
| 3,957,114 | A | 5/1976 | Streich |
| 4,133,386 | A | 1/1979 | Knox |
| 4,175,619 | A | 11/1979 | Davis |
| 4,190,112 | A | 2/1980 | Davis |
| 4,413,682 | A | 11/1983 | Callihan et al. |
| 4,442,894 | A | 4/1984 | Callihan et al. |
| 4,624,312 | A | 11/1986 | McMullin |
| 4,674,569 | A | 6/1987 | Revils et al. |
| 4,856,592 | A | 8/1989 | Van Bilderbeek et al. |
| 4,961,465 | A | 10/1990 | Brandell |
| 5,058,671 | A | 10/1991 | Cochran |
| 5,058,672 | A | 10/1991 | Cochran |
| 5,105,883 | A | 4/1992 | Bode |
| 5,146,992 | A | 9/1992 | Baugh |
| 5,197,553 | A | 3/1993 | Leturno |
| 5,234,052 | A | 8/1993 | Coone et al. |
| 5,242,018 | A | 9/1993 | Lafleur |
| 5,246,069 | A | 9/1993 | Glaser et al. |
| 5,311,940 | A | 5/1994 | Lafleur |
| 5,323,858 | A | 6/1994 | Jones et al. |
| 5,361,835 | A | 11/1994 | Lafleur |
| 5,433,270 | A | 7/1995 | Lafleur |
| 5,435,386 | A | 7/1995 | Lafleur |
| 5,472,057 | A | 12/1995 | Winfree |
| 5,483,986 | A | 1/1996 | Onan et al. |
| 5,551,521 | A | 9/1996 | Vail, III |
| 5,613,567 | A | 3/1997 | Hudson |
| 5,647,434 | A | 7/1997 | Sullaway et al. |
| 5,819,846 | A | 10/1998 | Bolt, Jr. |
| 5,894,897 | A | 4/1999 | Vail, III |
| 5,909,771 | A | 6/1999 | Giroux et al. |
| 6,082,451 | A | 7/2000 | Giroux et al. |
| 6,158,531 | A | 12/2000 | Vail, III |
| 6,244,342 | B1 | 6/2001 | Sullaway et al. |
| 6,263,987 | B1 | 7/2001 | Vail, III |
| 6,311,775 | B1 | 11/2001 | Allamon et al. |
| 6,397,946 | B1 | 6/2002 | Vail, III |
| 6,497,291 | B1 | 12/2002 | Szarka |
| 6,547,007 | B2 | 4/2003 | Szarka et al. |
| 6,868,906 | B1 | 3/2005 | Vail, III |
| 6,945,326 | B2 | 9/2005 | Mikolajczyk |
| 7,013,997 | B2 | 3/2006 | Vail, III |
| 7,036,610 | B1 | 5/2006 | Vail, III |
| 7,040,420 | B2 | 5/2006 | Vail, III |
| 7,048,050 | B2 | 5/2006 | Vail, III |
| 7,090,004 | B2 | 8/2006 | Warren et al. |
| 7,100,710 | B2 | 9/2006 | Vail, III |
| 7,108,084 | B2 | 9/2006 | Vail, III |
| 7,147,068 | B2 | 12/2006 | Vail, III |
| 7,165,634 | B2 | 1/2007 | Vail, III |
| 2002/0000318 | A1 | 1/2002 | Allamon et al. |
| 2002/0129944 | A1 | 9/2002 | Moore et al. |
| 2002/0148615 | A1 | 10/2002 | Szarka et al. |
| 2004/0060700 | A1 | 4/2004 | Vert |
| 2005/0103493 | A1 | 5/2005 | Stevens et al. |
| 2006/0102338 | A1 | 5/2006 | Angman et al. |

FOREIGN PATENT DOCUMENTS

| | | |
|---|---|---|
| WO | 2004/053288 | 6/2004 |
| WO | WO 2004/053289 | 6/2004 |
| WO | 2005/052316 | 6/2005 |

OTHER PUBLICATIONS

Bob Tessari, Garret Madell, Casing Drilling—A Revolutionary Approach to Reducing Well Costs, SPE/IADC Drilling Conference, Amsterdam, Holland, Mar. 9-11, 1999.

Tommy Warren et al, "Casing Drilling Technology Moves to More Challenging Applications" AADE 01-NC-HO-32, AADE National Drilling Technical Conference, Houston, Texas, Mar. 27-29, 2001.

ANCHORING DEVICE FOR A WELLBORE TOOL

FIELD OF THE INVENTION

This invention relates to an anchoring device for a wellbore tool and, in particular, an anchoring device for expanding into a liner recess such as for use in a cement float tool, bridge plug or packer and method for using same.

BACKGROUND OF THE INVENTION

The method of constructing wells using casing as the drill string, where the bottom hole drilling assembly is deployed through the casing, does not permit incorporating devices such as a cement float shoe directly into the casing string in the conventional manner. Furthermore, the casing cannot be provided with an internally upset interval, on which to land a device introduced after drilling, as this would restrict the casing internal diameter preventing deployment of the bottom hole drilling assembly. In Canadian patent application CA 2,311,160, Vert and Angman disclose a cement float that can be positioned downhole in a casing string provided with a suitable profile nipple.

The function of a typical installed cement float requires it to act as a check valve allowing flow down a casing string suspended in a borehole but preventing backflow, sealing the casing bore from differential bottom pressure. This pressure differential exists during well cementing processes after wet cement is placed in the casing and displaced into the borehole-casing annulus by a lighter fluid. It is created by the difference in hydrostatic head between the cement and a lighter displacing fluid, commonly water, and in turn induces an axial load that must be reacted into the casing. This axial load increases with the differential pressure and the sealed area. Thus, the required structural capacity of such devices is greater for larger diameter casing and deeper wells.

Other devices must also be anchored downhole such a packers and other valves. These devices can also require anchoring arrangements that operate in pressure differentials.

SUMMARY OF THE INVENTION

An anchoring device for a wellbore tool has been invented. The anchoring device can be installed on a tool and used for running downhole into engagement with an internal recess formed in a downhole pipe, such as for example, casing or another liner. As such, the anchoring device does not rely on the presence of internal restrictions. A profile nipple is an example of an element of casing carrying a recess. The profile nipple can be installed when the downhole pipe is run into the hole and, therefore, can already be in place when it is desired to anchor a tool in the wellbore, such as when total depth (TD) is reached.

In accordance with a broad aspect of the present invention, there is provided an anchoring device for use in a pipe, the pipe including an inner diameter with an annular recess formed therein, the annular recess having a length and having a diameter greater than the inner diameter of the pipe, the anchoring device comprising: a mandrel having an outer surface, an upper end and a lower end, the mandrel sized to move through the pipe in which it is to be used; a radially resilient anchor carriage mounted about the mandrel, the anchor carriage defining an inner surface and a substantially cylindrical outer surface, the anchor carriage having a length selected to be less than the pipe annular recess length and being sized to pass through the pipe when radially compressed and to have an outer diameter when radially expanded greater than the pipe inner diameter and interengaging grooves and elongate protrusions formed on the mandrel outer surface and on the anchor carriage inner surface, the interengaging grooves and elongate protrusions of the anchor carriage and the mandrel being selected to limit axial movement of the anchor carriage relative to the mandrel and to permit the anchor carriage to be compressed against the mandrel to fit inside the inner diameter of the pipe and to remain interengaged when the anchor carriage is expanded and latched into the annular recess of the pipe.

In accordance with another broad aspect of the present invention, there is provided a cement float for use in casing, the casing including an inner diameter with an annular recess formed therein, the annular recess having a length and having a diameter greater than the inner diameter of the casing, the cement float including: a mandrel having an outer surface, an upper end, a lower end and an axial bore extending from its upper end to its lower end, the mandrel sized to move through the casing in which it is to be used; a radially resilient anchor carriage mounted about the mandrel, the anchor carriage defining a substantially cylindrical outer surface and an inner surface, the anchor carriage having a length selected to be less than the casing annular recess length and being sized to pass through the casing when radially compressed and having an outer diameter when radially expanded greater than the casing inner diameter, interengaging grooves and elongate protrusions on the anchor carriage inner surface and on the mandrel outer surface selected to limit axial movement of the anchor carriage relative to the mandrel and to permit the anchor carriage to be compressed against the mandrel to fit inside the inner diameter of the casing and to remain interengaged when the anchor carriage is expanded and latched into the annular recess of the casing; a one way valve in mandrel axial bore; and a seal about the mandrel for sealing between the mandrel and the casing.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings:

In FIG. 2 the float valve is open permitting flow of fluids downwardly through the cement float tool, while in FIG. 3 the float valve is closed preventing reverse flow therethrough;

DESCRIPTION OF EMBODIMENTS OF THE INVENTION

Figure 1:
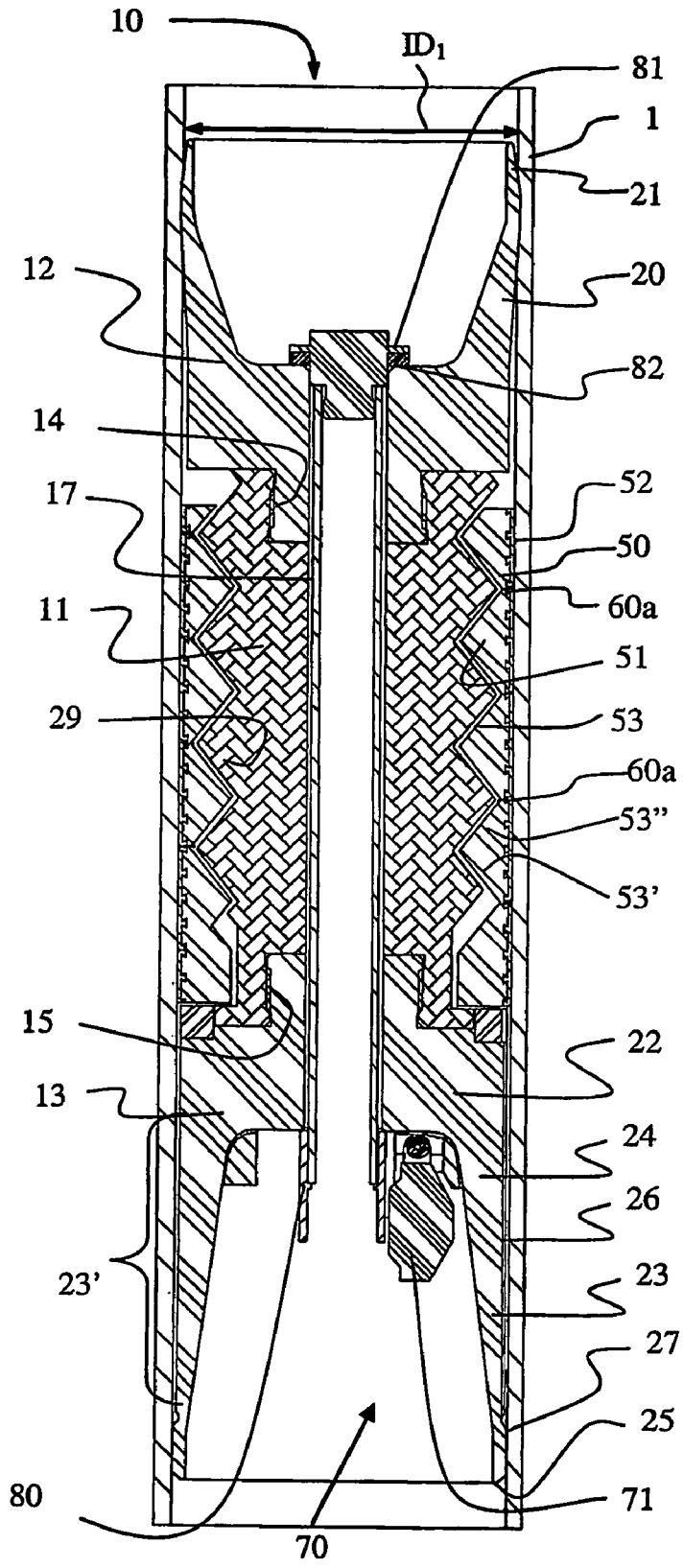
FIG. 1 is a vertical section through a portion of well casing including an anchoring device on a tool, in the form of a cement float tool, in a configuration for passing through the well casing as it would appear being pumped down the casing during installation.

An anchoring device for a wellbore tool is described herein. The anchoring device can be installed on a tool to be run downhole, for example by pumping, and can be positioned in engagement with an internal recess formed into a pipe wall, for example of casing. The element of casing carrying the recess is herein called the profile nipple. As such, no restriction is needed in the casing for accepting or latching the tool, and the profile nipple can be installed at the start of the drilling operation and therefore can already be in place when it is desired to install the tool to be anchored. The profile nipple can be used to engage other drilling tools as well, if desired.

The annular recess of the casing has a length and has a diameter greater than the inner diameter of the casing. The anchoring device can include a mandrel having an outer surface, an upper end and a lower end and a radially resilient anchor carriage mounted about the mandrel. The anchor carriage can define a substantially cylindrical outer surface and an inner surface. The anchor carriage can have a length selected to be less than the casing annular recess length and be sized to pass through the casing when radially compressed and to have an outer diameter greater than the casing inner diameter when radially expanded. The anchoring device can further include interengaging grooves and elongate protrusions formed on the mandrel outer surface and on the anchor carriage inner surface, the interengaging grooves and elongate protrusions of the anchor carriage and the mandrel being selected to limit axial movement of the anchor carriage relative to the mandrel and to permit the anchor carriage to be compressed against the mandrel to fit inside the inner diameter of the casing and to remain interengaged when the anchor carriage is expanded and latched into the annular recess of the casing.

The anchoring device can support the installation of various wellbore tools tool that are desired to be anchored downhole, for example, a cement float, a bridge plug or a packer. Thus, it is to be understood that although the anchoring device is shown in association with a cement float, it can be used with other tool arrangements. The anchoring device can support in-situ installation in a wellbore completion operation after drilling or lining a wellbore with casing.

The mandrel and the anchor carriage each have formed thereon a plurality of elongate protrusions forming a plurality of grooves therebetween. The mandrel and anchor carriage are each formed to interengage at their grooves and elongate protrusions with the protrusions of one part fitting into the grooves of the other part. The interengagement between the grooves and protrusions can act to limit relative axial movement therebetween, both when the tool is being passed through the casing (wherein the anchor carriage is compressed about the mandrel) and when the tool is anchored into the annular recess of the casing (wherein the anchor carriage is expanded therein). The angles and the materials of the grooves/protrusions on the mandrel and the anchor carriage can be selected to maintain interengagement, with consideration as to the loads encountered during installation and operation. The grooves/protrusions can, for example, be V-shaped, generally squared off or rounded in cross section. They can be symmetric or otherwise.

The anchor device can be formed to withstand the rigours of installation and operation downhole. The anchoring device can support the use of non-metal components, for example where it is desirable to permit drilling out of the anchored tool and at least a portion of the anchoring device. The anchor carriage can be formed as a composite structure having an outer shell of durable material, such as for example steel, and an inner portion attached to the outer shell and formed of drillable material. The drillable material in one embodiment can be a non-metal such as plastic. In one embodiment, the grooves/protrusions on the inner sidewall of the carriage are formed of drillable material. The outer shell thickness can be selected not to exceed the depth of the annular recess in the casing.

The anchor carriage can be radially resilient to be compressed against the mandrel and fit into the casing, but capable of expanding to latch into the casing recess. The radial resiliency of the anchor carriage can be provided by configuring the anchor carriage to have a portion of its wall removed to thereby act as a C-spring. Alternately or in addition, the wall of the carriage can be formed as a helical spring to provide radial compliance. As such, the anchor carriage can normally be in an expanded configuration but can be urged into a compressed position. From the compressed position, the anchor carriage will be biased by its radial resiliency into the expanded position, unless maintained, as by a confining surface, in a compressed or partially expanded position.

In one embodiment, the entire anchor carriage can be formed as a C-ring. In another embodiment, a portion of the anchor carriage wall can be removed from its upper and lower ends to form notches and the wall in the mid-section between these notches can include a helical coil, formed as by cutting in a helical pattern, possibly coinciding with the location of a thread root. Thus, a structure can be obtained where the notched upper and lower intervals act as C-rings and the helically cut mid-section acts as a spring coil, joining the C-rings. In yet another embodiment, the anchor carriage can be formed along its length in a helical coil pattern.

It will be apparent that the application of radial compressive displacement to any such structures will have the effect of closing any C-ring sections and tightening any helically cut intervals, thus overall reducing the anchor carriage diameter, which diameter reduction is resisted primarily by increase of through-wall flexural stress providing the desired radial compliance.

Helically cut sections of the anchor carriage can, in one embodiment, be configured as a right hand helix such that under application of right hand drilling torque, the right hand helix geometry of the anchor carriage, when latched in a casing recess, can tend to expand the helix into further engagement with the recess, rather than tightening and compressing the coil to pull it out of the recess. This engagement provides a frictional self-locking effect and thus resists rotation of the anchored tool in the casing making it easier to drill out the anchored tool. Thus, with a combination of drillable and durable materials and including a helical geometry, the tool can withstand the rigours of passage downhole during installation, has sufficient elastic compliance to accommodate the diameter reduction required to permit insertion into the casing bore and correlative elastic diameter expansion to latch into the casing recess, but can be drilled out to permit the removal of substantially all of the tool should this be necessary, for example, to extend the borehole.

In an embodiment including a helical coil section, the facing edges of the helical returns cut can be formed to engage together, as by use of frictional engagement or a ratchet effect. In another embodiment, the helical coil and the mandrel can be oppositely tapered to provide a taper lock effect between the parts. For example, the mandrel outer diameter along its grooved portion from bottom to top can taper, while the anchor carriage walls increase in thickness with its outer cylindrical form maintained.

In one embodiment, the grooves/protrusions of the mandrel and of the anchor carriage are formed as threads, in another embodiment they are substantially axi-symmetric and extend substantially circumferentially and, in another embodiment, a combination of thread form and substantially circumferential grooves/protrusions are used. The grooves/protrusions of the anchor carriage can be formed to correspond to the anchor carriage approach to radial resiliency and the grooves/protrusions of the mandrel can be selected to correspond thereto. For example, where the anchor carriage resiliency is provided by a helical cut, the interengaging grooves/protrusions may also extend in a corresponding helical pattern.

In some embodiments, it may be desirable to create a pressure seal across the anchoring device. Thus, in one embodiment, the mandrel can carry a seal thereabout selected to seal between the mandrel and the casing. In one embodiment, the anchoring device can include a seal against flow upwardly and downwardly between the mandrel and the casing. The seal can be sufficient to substantially seal against fluids passing between the mandrel and the casing string at fluid pressures encountered in a wellbore operation during installation and with the anchor carriage latched into the recess of the casing string.

Installation of the anchoring device can be achieved by pushing it through the casing, as by use of a tubing string or by pumping down, where a pressure differential can be maintained across the tool.

When the tool is configured as a cement float tool, it will typically include a bore through the mandrel extending from its upper end to its lower end and a flow control assembly mountable on the tool to prevent flow of fluids through the bore of the mandrel at least from its lower end to the upper end. It may include a removable seal in the bore to support a pump down installation.

Figure 2:
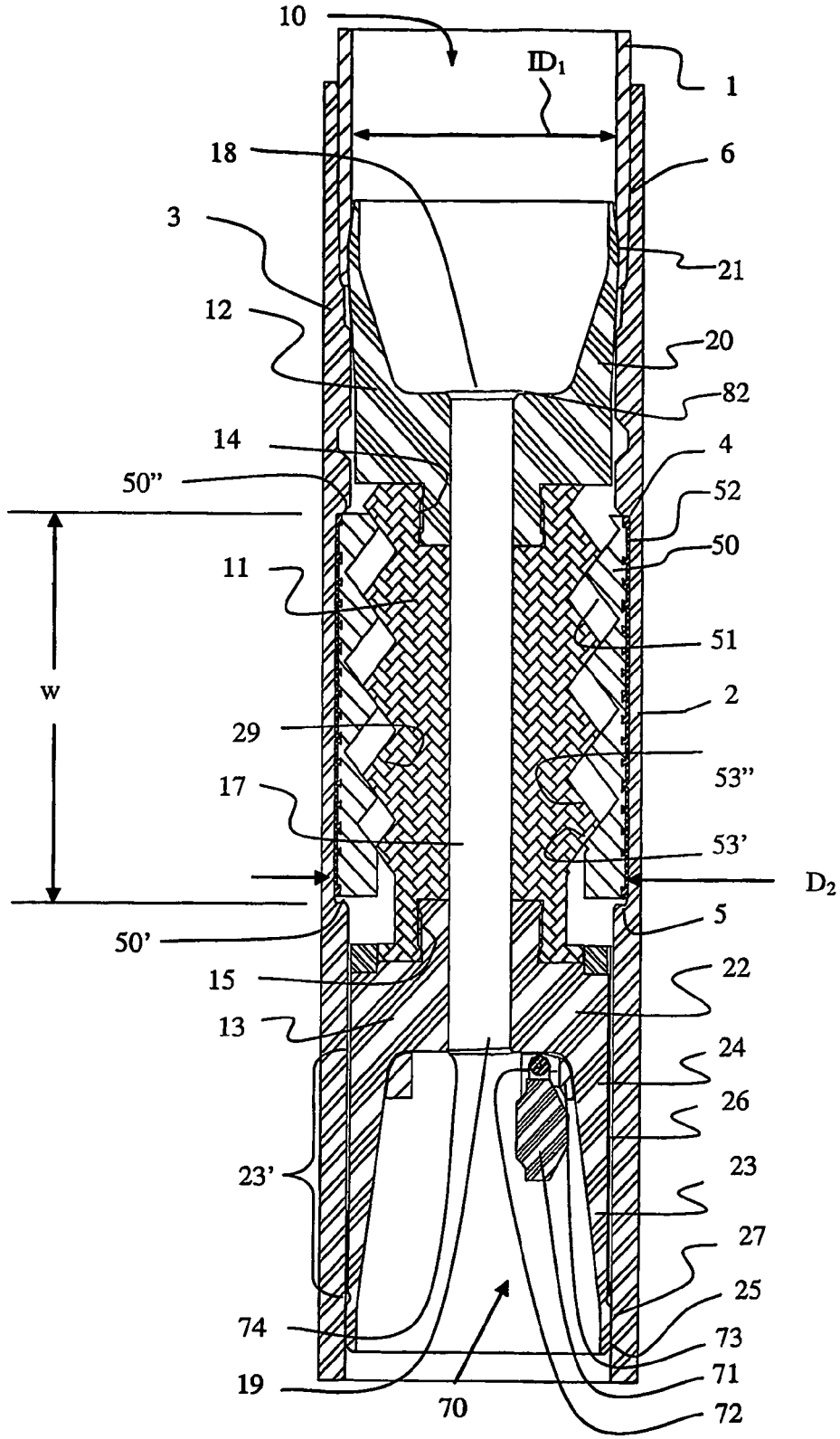
FIGS. 2 and 3 are vertical sectional views of the cement float tool of FIG. 1 in latched positions in a portion of well casing.
Figure 3:
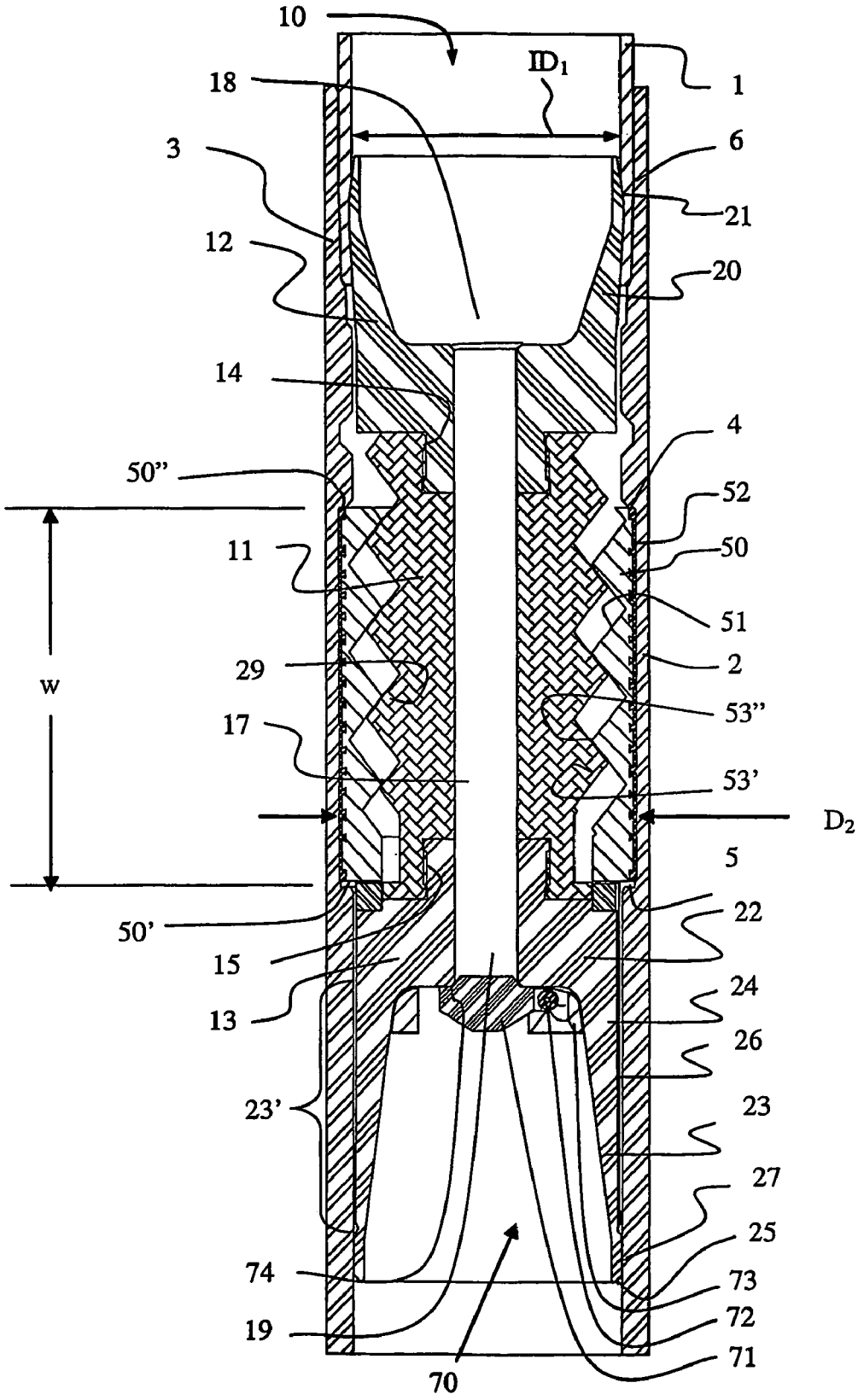

Referring to FIGS. 1 to 3, a cement float tool 10 including an anchoring device according to one embodiment is shown. Cement float tool 10 is configured to pass through a tubular string of casing, a portion of which is shown at 1. Casing 1 has a specified minimum inner diameter $ID_1$, commonly referred to as the drift diameter, so as not to limit the size of a tool that can pass therethrough. An annular recess 2 FIGS. 2 and 3) is placed, as by machining, in a profile nipple 3 adapted to connect into the distal end of the casing string by, for example, threaded connections illustrated by the casing to profile nipple connection 6. The diameter $D_2$ in recess 2 is slightly larger than the minimum inner diameter of the casing tubing. The cement float tool is configured to be pumped through a string of casing and to latch via its anchoring device into and be retained in the annular recess, as will be more fully described hereinafter. The annular recess 2 is formed to permit the cement float tool to be accepted without consideration as to its rotational orientation in the casing.

FIG. 1 shows the cement float tool in a position being moved through a section of casing, while FIGS. 2 and 3 show the cement float tool 10 secured in the casing in the annular recess of a profile nipple.

Cement float 10 includes a mandrel 11 joined to a top seal cup 12 and a bottom seal cup 13 by generally sealing upper and lower threaded connections 14 and 15, respectively. Upper and lower threaded connections 14 and 15 respectively, can be provided to facilitate manufacture and assembly and to allow more optimal selection of materials. However, it is to be understood that other mounting configurations can be used, as desired. The mandrel and seal cups together can form a longitudinal bore 17 through the tool extending from upper end opening 18 in top seal cup 12 to lower end opening 19 in bottom seal cup 13. It will be apparent that the bore can be formed in other ways, for example, by extending the mandrel body through the seal cup bodies. The cement float can be sized to pass through $ID_1$, of the size of casing in which it is intended to be used with seal cups 12, 13 sealable against the $ID_1$.

Seal cups can be formed in various ways and from various materials, as will be appreciated. The seal cup material can be selected to be more compliant than the casing material (generally steel) against which the cup material is to seal. The seal cup material can also be selected with consideration as to the pressure loads in which it must seal. Of course, the material used can also be considered for thermal response, such as expansion and compliancy, to achieve a sealing action. In one embodiment, top seal cup 12 can be formed from a compliant (relative to casing material) and drillable material, such as polyurethane, and can have a surface coating of wear resistant material. Top seal cup 12 can include an elongate tubular wall 20, configured with at least one external upper seal land and selected to adequately seal between the casing and main body against top pressure required to pump the cement float tool down the casing until latched in the profile nipple 3 and any subsequent top pressuring as may be required to, for example, fail a shear plug as described hereinafter. In the illustrated embodiment, upper seal cup 12 includes a seal land 21. In some embodiments, it may be useful to configure a seal cup with multiple seal lands having diameters, length and spacing selected so as to span small gaps such as at a connection 6. Thus described, it will be apparent to one skilled in the art that top seal cup 12 is generally configured in a manner known to the industry for a cementing plug, a cement wiper plug or a packer cup and can be modified in various ways.

Similarly, bottom seal cup 13 can be formed from a compliant (relative to casing material), drillable structural material such as fiber reinforced polyurethane selected to operate under the pressure loads to be expected in operation. It can also be formed in various ways. In one embodiment, a seal cup can be used that assists with anchoring tool 10 in the casing and in the illustrated embodiment, such a seal cup is illustrated as bottom seal cup 13 and will be described hereinbelow with reference to FIG. 4.

The external surface of the mandrel 11 carries external coarse threads 29 creating a means of structurally reacting loads from the cement float tool. To provide adequate load transfer capacity while yet being readily drillable, mandrel 11 can be made from a rigid, strong yet frangible material such as a reinforced phenolic or high temperature granular reinforced resin-based grout.

A radially resilient anchor carriage 50 is mounted coaxially about mandrel 11 and provided with internal coarse threads 51 engaging in the axial direction the external coarse threads 29 of the mandrel, forming a threaded connection therebetween.

Numerous variations in the coarse thread form, such as for example buttress thread forms, may be employed as desired. In the one embodiment, as is illustrated as an example, satisfactory pump down and anchoring performance can be provided using a symmetric V-thread having an included angle of approximately 90°. In this thread form, the angles of stab flank 53' and load flank 53" with respect to the tool axis can be approximately 45° from the long axis of the mandrel.

Anchor carriage 50 can be formed of various materials that provide for performance in downhole conditions, resiliency and in load transfer, as will be appreciated. Where it is desirable that anchor carriage be drillable to gain access below the tool, the anchor carriage can be formed at least in part of drillable materials. In one embodiment, anchor carriage 50 can be formed as a composite structure having an outer shell 52 of durable material, such as steel, attached to an inner layer 54 made of a weaker, more drillable material, such as fibre reinforced polyurethane, into which the inner coarse threads 51 are formed. If desirable, the thickness of outer shell 52 can be selected not to exceed the depth of the annular recess 2 provided in the profile nipple 3 and into which the anchor carriage is to land such that the high strength outer shell 52 need not be drilled out when drilling out the remainder of the cement float tool to the casing internal diameter $ID_1$ after cementing. In some embodiments, load transfer can be enhanced between inner layer 54 and outer shell 52 by forming these parts to be interengaged. For example, a plurality of spaced internal grooves 55 can be provided engaging matching teeth 56 on the exterior of the inner layer 54. The internal grooves 55 may be axi-symmetric, helical or formed otherwise, and can be readily provided by machining, as for example multi-start threads having a pitch corresponding to that of the coarse threads 51. The engaging teeth 56 can be readily created by casting the material comprising the inner layer 54 into the internal grooves 55 cut into the shell 52. Even more beneficial load transfer capability can be achieved where the internal grooves 55 and mating teeth 56 are shaped to have reverse angle flanks 57, so as to create a dovetail joint interconnection.

The radial resilience of anchor carriage 50 allows it to be compressed down to fit inside the diameter $ID_1$ of the casing 1 for installation (FIG. 1) and yet elastically expand (FIG. 2) sufficient to engage the recess 2 of the profile nipple 3 when released. Correspondingly, the geometry of internal coarse threads 51 and external coarse threads 29 can be selected to ensure anchor carriage 50 can sufficiently compress about the mandrel for installation, as shown in FIG. 1, and yet still provide substantial engagement with the mandrel and, therefore, axial load transfer when expanded into recess 2 as shown in FIG. 2.

To provide radial resiliency, the anchor carriage can be formed as a helical coil, similar to a coil spring, as shown in FIGS. 1 to 3, the returns of the coil being slidable at their interfaces 60*a* such that the coil can be compressed, by the returns sliding past one another, but is biased into an expanded position by the tension in the material of the anchor carriage. The anchor carriage can, for example, be threaded onto the mandrel during assembly of the tool.

Figure 5:
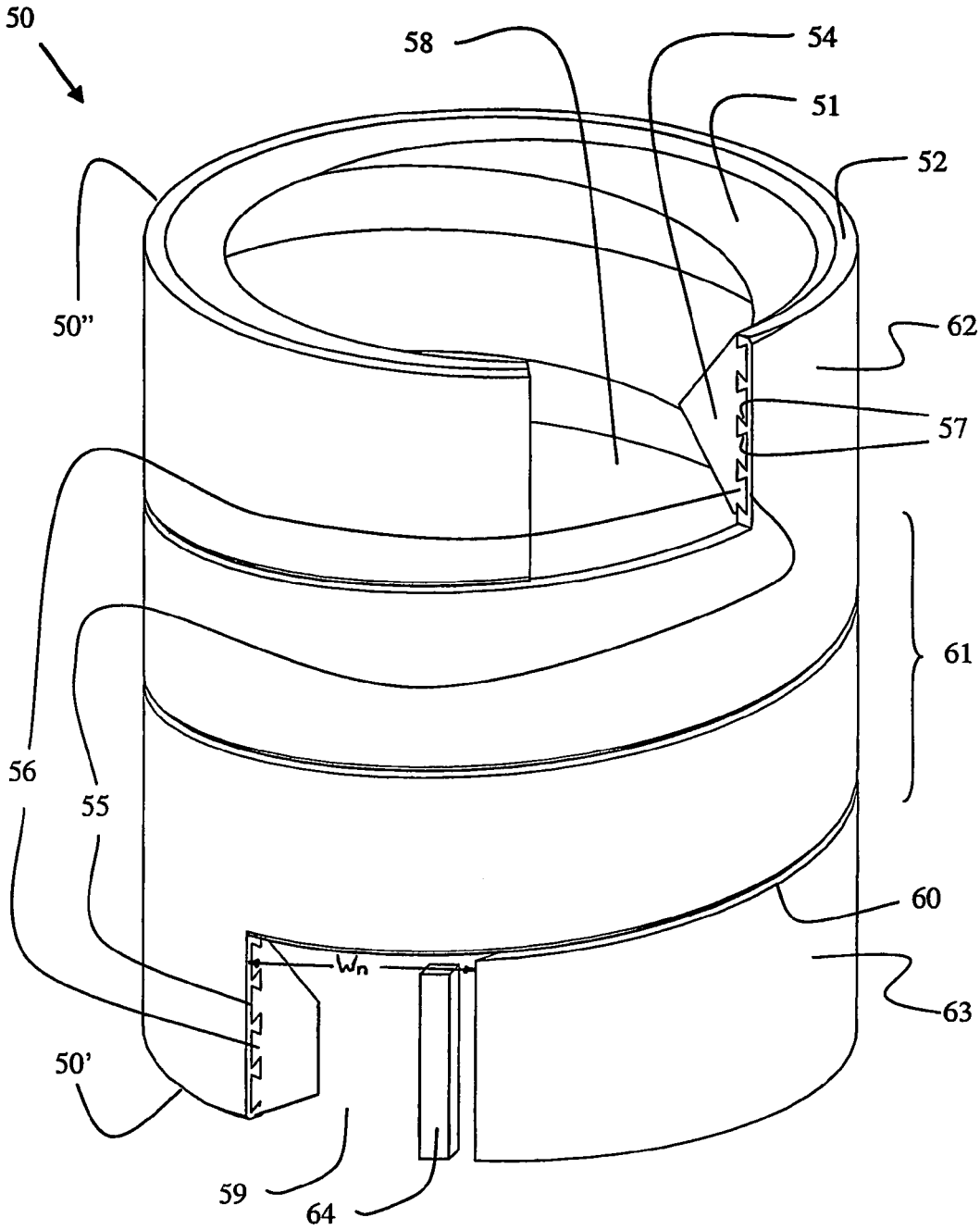
FIG. 5 is a perspective view of an anchor carriage useful in an anchoring device as it would appear expanded.

In another embodiment shown in FIG. 5, the radial compliance of anchor carriage 50 can be provided by configuring it to have a portion of its wall removed from its ends to form upper and lower notches 58 and 59 respectively and a helical cut 60 through the wall in mid-section 61 between notches 58 and 59. This combination of notches connected by a helical cut creates a structure where the ends about upper and lower notches 58 and 59 define what behave as upper and lower C-ring intervals 62 and 63 respectively, which intervals are joined by a spring coil defined by the helically cut mid-section 61. It will be apparent that application of radial compressive displacement to such a structure will have the effect of closing the C-ring sections 62 and 63 and tightening the helically cut mid-section interval 61 thus overall reducing the diameter of the anchor carriage 50, which diameter reduction is resisted primarily by increase of through-wall flexural stress providing the desired radial resilience. The circumferential width Wn of notches 58 and 59 is selected to accommodate a diameter reduction of the C-ring intervals 62 and 63 sufficient to permit insertion of the anchor carriage into casing of minimum internal diameter $ID_1$. In such an embodiment, it is useful to form the elongate protrusions of the mandrel and the grooves 51 of the anchor carriage as corresponding coarse threads. The base (roots) of grooves 51 can substantially follow helical cut 61. To restrict unthreading of the interengaging grooves and elongate protrusions, the thread form can open near the bottom of the anchor carriage into a circumferential protrusion to cause the anchor carriage to bottom out against the shoulder of a circumferential groove on the mandrel.

It may be useful to restrict rotation of the anchor carriage about the mandrel to prevent 'unthreading' which may occur during installation and/or to resist drilling torque loads applied to mandrel 11 during drill-out. In another embodiment, for example, lower notch 59 may be further utilized to lock the anchor carriage relative to a key 64 fastened to mandrel 11. Key 64 can be secured to extend out from the mandrel to abut the edges forming notch 59. Thereby, key 64 can lock the relative rotational position of the anchor carriage 50 on the threads 29 of the mandrel to prevent 'unthreading' occurring during installation and to further resist drilling torque loads applied to mandrel 11 during drill-out. In particular, when pin 64 is rigidly secured to the mandrel and notch 59 is aligned thereover, the carriage cannot rotate past the pin, to be threaded off the mandrel.

Where a drillable tool is desired, it can be useful to configure the helically cut midsection interval 61 of the anchor carriage 50 as a right hand helix. Under application of right hand drilling torque, as would typically be used to drill out the cement float tool, the right hand helix geometry of the anchor carriage mid-section 61, when latched in recess 2, tends to expand the confined helix, creating a frictional self-locking effect resisting rotation to thus improve drill-out performance.

In another embodiment (not shown), the radial resilience of the anchor carriage can be achieved by omitting a helical cut and, instead, forming the anchor carriage entirely as a C-ring. Where the radial compliance is, thus, obtained with a C-ring structure, the interlocking between the anchor carriage can be provided as coarse grooves/protrusions formed axi-symmetrically. In this configuration, the C-ring must be 'sprung open' to facilitate initial placement of the anchor carriage onto the mandrel.

Referring now to FIG. 2, anchor carriage 50 has a length between its leading edge 50' and its trailing edge 50" that is less than the width w of recess 2 such that the anchor carriage 50 can completely expand into the recess. Recess 2 is formed with upper and lower shoulders 4 and 5 respectively, that step generally abruptly from $D_2$ to $ID_1$. The exposed corners of upper and lower shoulders 4 and 5 are can be radiused or chamfered to facilitate movement there-past of equipment, for example during drilling. However, since shoulders 4 and 5 act to retain anchor carriage so at it ends, the ends and shoulder must be formed for load bearing engagement and any radius or chamfer should not be so great as to inhibit or jeopardize firm latching of the anchor carriage 50 into recess 2. When the anchor carriage 50 expands into recess 2 it becomes latched therein by abutment of leading edge 50' against lower shoulder 5 of the recess (FIG. 2). Upwards movement of cement float tool 10 is limited by abutment of edge 50" against the upper shoulder 4 of the recess (FIG. 3). The outward facing corner of leading edge 50' can be curved or chamfered to facilitate movement through the casing string and over discontinuities such as might occur at casing connections. Any such curvature or chamfering, however, should be of a limited radius or depth so as to avoid interference with secure latching of the anchor carriage 50 into recess 2 and abutment against lower shoulder 5. In an embodiment where it is desirable to avoid axial rotation of the anchor carriage in recess 2, the anchor carriage can be selected to have an interference fit in the recess as by selecting the anchor carriage to have an expanded outer diameter greater than $D_2$.

In one embodiment, a seal cup can be used that assists with anchoring tool 10 in the casing and in the illustrated embodiment, such a seal cup is illustrated as bottom seal cup 13 and will be described with reference also to FIG. 4. Such a seal cup can include a base with a diameter selected to pass through the casing in which it is to be used and a tubular wall extending from the base and including an outer end, at least one circumferential external seal land adjacent the outer end, the diameter of the seal land being selected to allow sealing engagement with the casing inner diameter in which it is to be used, the tubular wall including an external surface defining an outer diameter of the seal that generally tapers from the seal land to the base and the tubular wall having a thickness that substantially increases from the outer end to the base.

The external surface of the tubular wall can permit seepage of fluid from adjacent the seal land past the base to act against pressure invasion about the external surface.

In operation seal cup 13 tends to be self-anchoring under application of bottom differential pressure. Axial load generated by the pressure differential is reacted by frictional sliding resistance between the seal cup tubular wall and the confining casing wall. This self-anchoring mechanism arises because the exterior seal formed at the outer end of the seal cup permits differential pressure to be applied as internal radially-directed pressure across the tubular wall. This effect is also permitted by the external cup surface between the seal land and the base, which under bottom pressure is capable of conducting seepage fluid from adjacent the seal land past the base and out of the interface between the seal cup and the casing against which it is sealed. This external surface, which permits seepage, can, for example, be roughened, scored, formed with seepage grooves, or formed of porous material. The compliance of the selected structural plastic, allows the tubular interval to expand readily under application of modest pressure until it contacts the confining casing wall. Application of additional pressure serves to directly increase the interfacial contact stress and proportionately the axial force required to induce frictional sliding between the seal cup tubular interval and the casing wall; Axial load arising from differential pressure acting across the base may thus be reacted in part by tension where it is joined to the tubular interval, reducing or even eliminating the axial pressure end load that needs to be reacted through the anchoring device of the tool.

It will be appreciated that this self-anchoring mechanism greatly reduces the load capacity required from an anchoring system on a tool and thus, enhances the anchoring properties in a tool. For example, with consideration as to the present anchoring device, in combination with shear area efficiencies gained by reacting load from the mandrel into the anchor carriage through coarse thread engagement, this seal cup architecture provides a substantial improvement in the ability to use lower strength, readily drillable materials in the mandrel and anchor carriage.

Figure 4:
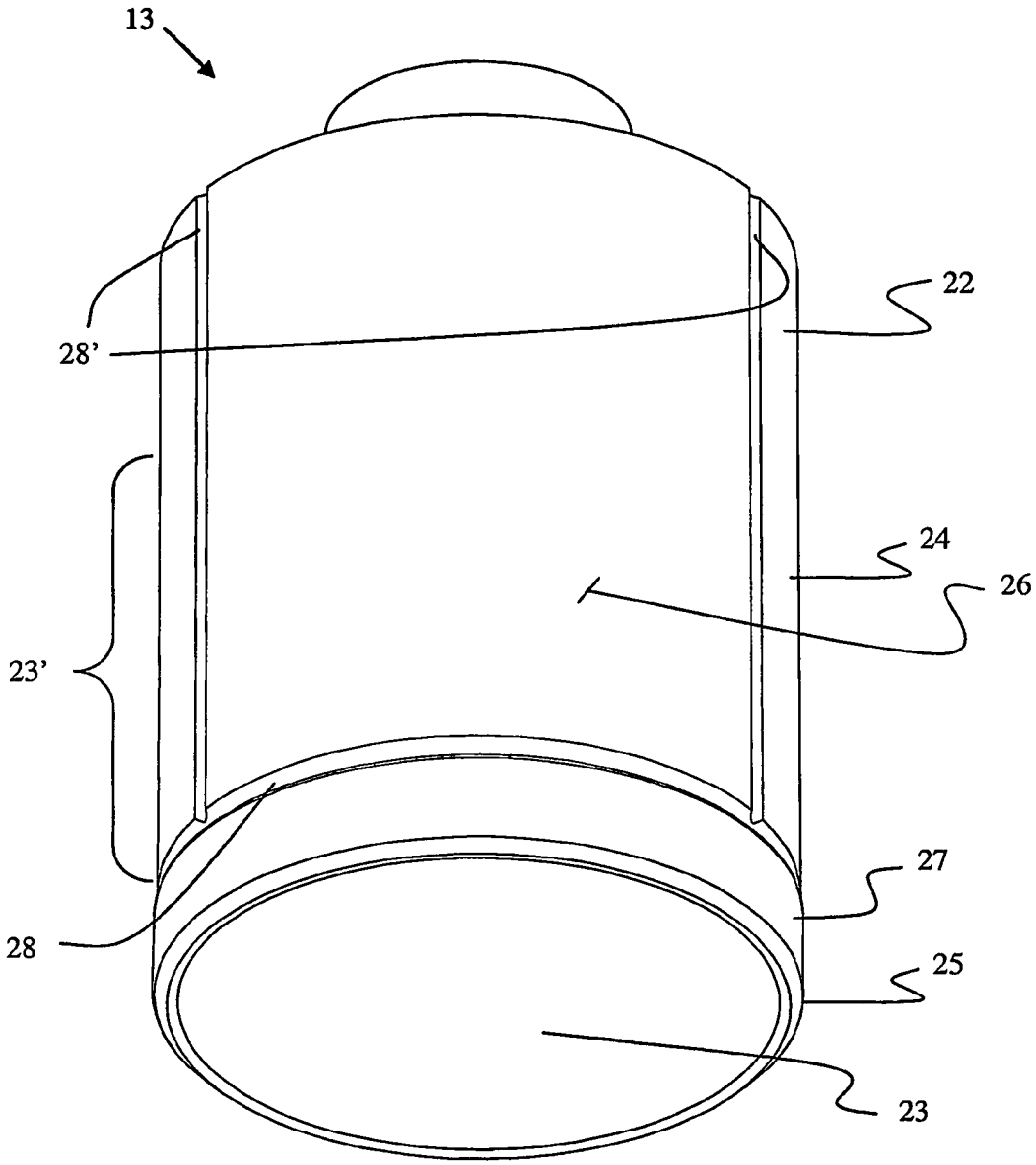
FIG. 4 is a perspective view of a bottom cup seal useful in an anchoring device.

Referring also to FIG. 4, anchoring seal cup 13 can be shaped as by molding or machining to have a base 22 integral with an elongate seal tube 23. The seal tube can include an end 24 attached to the base 22 and an opposite end 25 open, thus forming a cup, which in the illustrated embodiment opens downwardly relative to the tool. The external surface 26 of seal cup 13 is profiled to have at least one slightly raised circumferential external seal land 27 adjacent end 25. The diameter at the seal land can be selected to allow sealing or near sealing engagement with casing inner diameter, such as the profile nipple 3 directly below recess 2 in which it is to be used. Diameter at base 22 can be similar to the drift or minimum running diameter. The interval 23' extending from seal land 27 to the seal tube end 24 can be generally tapered to blend with the base 22. External surface 26 is further provided with a circumferential seepage groove 28 directly adjacent seal land 27 on its sealed side (closest to base 22) and one or more seepage grooves 28' extending from groove 28 toward the base, which grooves are sized to permit passage therethrough of well bore fluids that might seep past seal land 27 when acting to seal against bottom pressure.

Figure 4A:
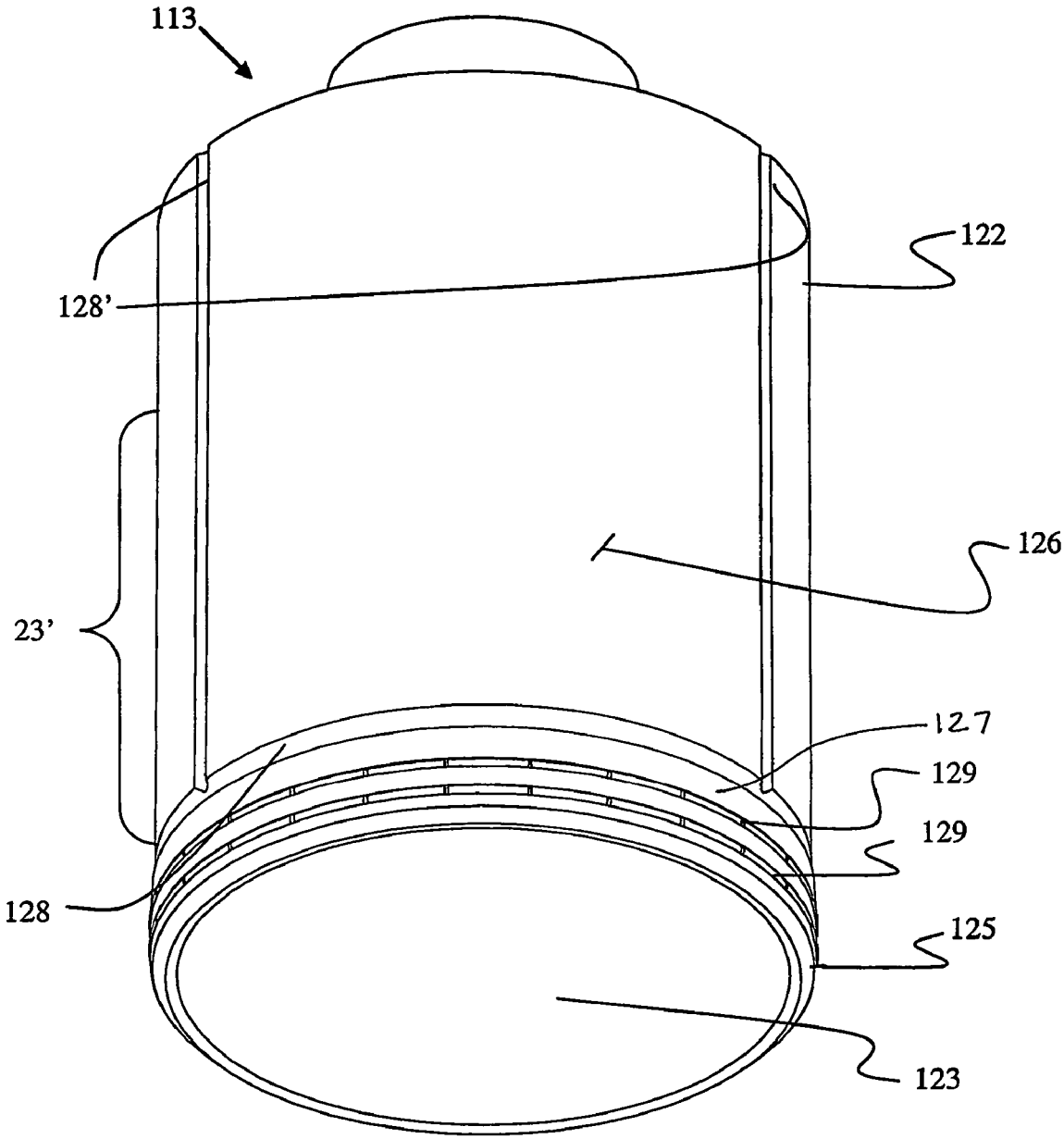
FIG. 4A is another perspective view of a cup seal useful in an anchoring device.

External surface 26 can further be provided with surface acting wear resistant material, to provide durability against damage during, for example, run in. Referring for example, to seal cup 113 of FIG. 4A. Seal cup 113 includes an external circumferential seal land 127 on its outer surface 126. Wear resistant inserts 129 in the form of hardened steel wires mounted in glands, as by dovetailing engagement, are provided in the seal region adjacent the seal land. Inserts 129 can be used to protect the seal land of the cup from excess wear that may deleteriously affect the seal performance of the seal cup.

The inserts can be spaced and configured to provide spaced or substantially uniform circumferential coverage, but to allow sufficient end clearance to permit radial compliance to pass over diameter reductions along the casing, as at threaded connections, and sealing expansion as is required in the sealing region.

While inserts of annular steel wire have been shown, other wear resistant inserts or surface coatings can be used as desired. While two rows of inserts have been shown positioned on the seal land, other numbers (i.e. one or more) and positions can be used.

Since the tool of the illustrated embodiment is a cement float, a float valve or check valve can be positioned in bore 17 of main body 11 to permit only one-way flow therethrough from upper end opening 18 to lower end opening 19. While other one-way check valves such as, for example, ball valves are useful, the illustrated check valve 70 is a flapper valve including a flapper 71 mounted via a hinge pin 72 to a flapper valve housing 73. As will be appreciated by a person skilled in the art, flapper 71 can be formed to seal against a seat 74 formed at the lower end opening 19 in the base 22 of lower cup 13 when a flow of fluid tends to move through the bore in a direction from lower end opening 19 to upper end opening 18 (FIG. 3). Flapper 70 is normally biased into the sealing position against seat 74 by a spring (not shown) such as, for example, a torsion spring acting about hinge pin 72. Flapper valve housing 73 may be secured to lower cup base 22 by various means including, for example, bonding to the inside of seal cup 13 (as shown) or threaded engagement. Other valve types such as, for example, ball valves can be used, as desired, provided that they are durable enough to withstand the passage of cement therethrough. In other embodiments, the valve is provided in the bore of the mandrel.

For pumping downhole, a releasable plug 80 can be disposed in bore 17. Releasable plug 80 can be selected to remain in plugging position within bore 17 up to a selected maximum pressure. At pressures above the selected maximum pressure, plug 80 can be driven out of bore 17. While many suitable pressure releasable plugs are known, the illustrated cement float tool can include a plug having a flange 81 sealingly engaged on a shoulder 82 in top seal cup 12. When pressure acting against the plug is increased above the selected maximum pressure, the flange shears away from the plug body and the plug is expelled from bore 17. The length of plug 80 may be selected such that it extends past flapper valve 70 thus mitigating against possible damage to flapper 71 when the plug is expelled. The plug can be retained by several different means such as, for example, bonding of flange 81 into shoulder 82. In another embodiment, a burst plate can be used rather than a plug that is expelled. In a standard completion operation, the selected maximum pressure for expelling the plug can be greater than the normal pressure required to pump the plug down the casing. For example, the pressure to pump down a cement float tool would typically be less than 500 psi. In a one embodiment, releasable plug 30 is selected to remain in place in the bore unless fluid pressures above the plug exceed about 1500 psi.

Figure 6:
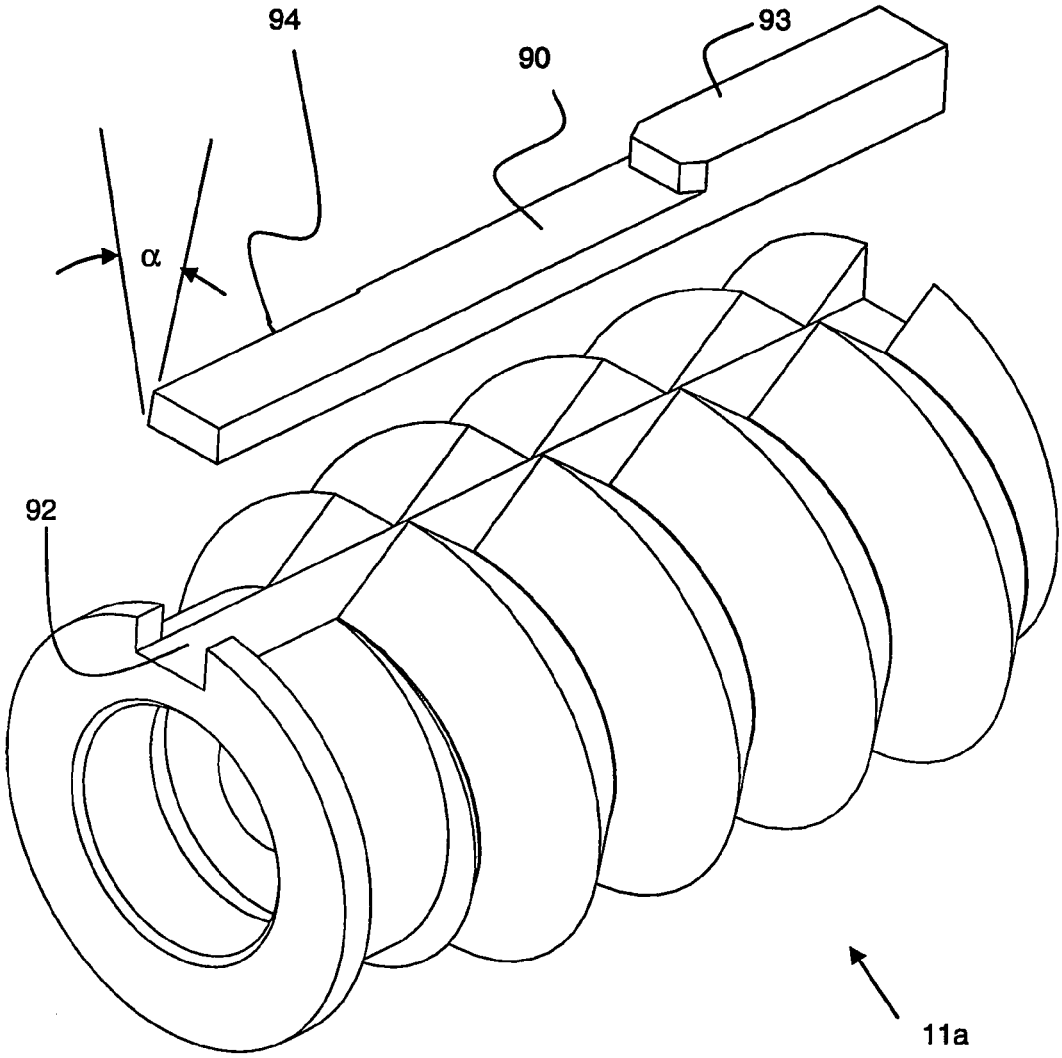
FIG. 6 is a perspective view of a mandrel, with a key way and key, useful in an anchoring device.
Figure 7:
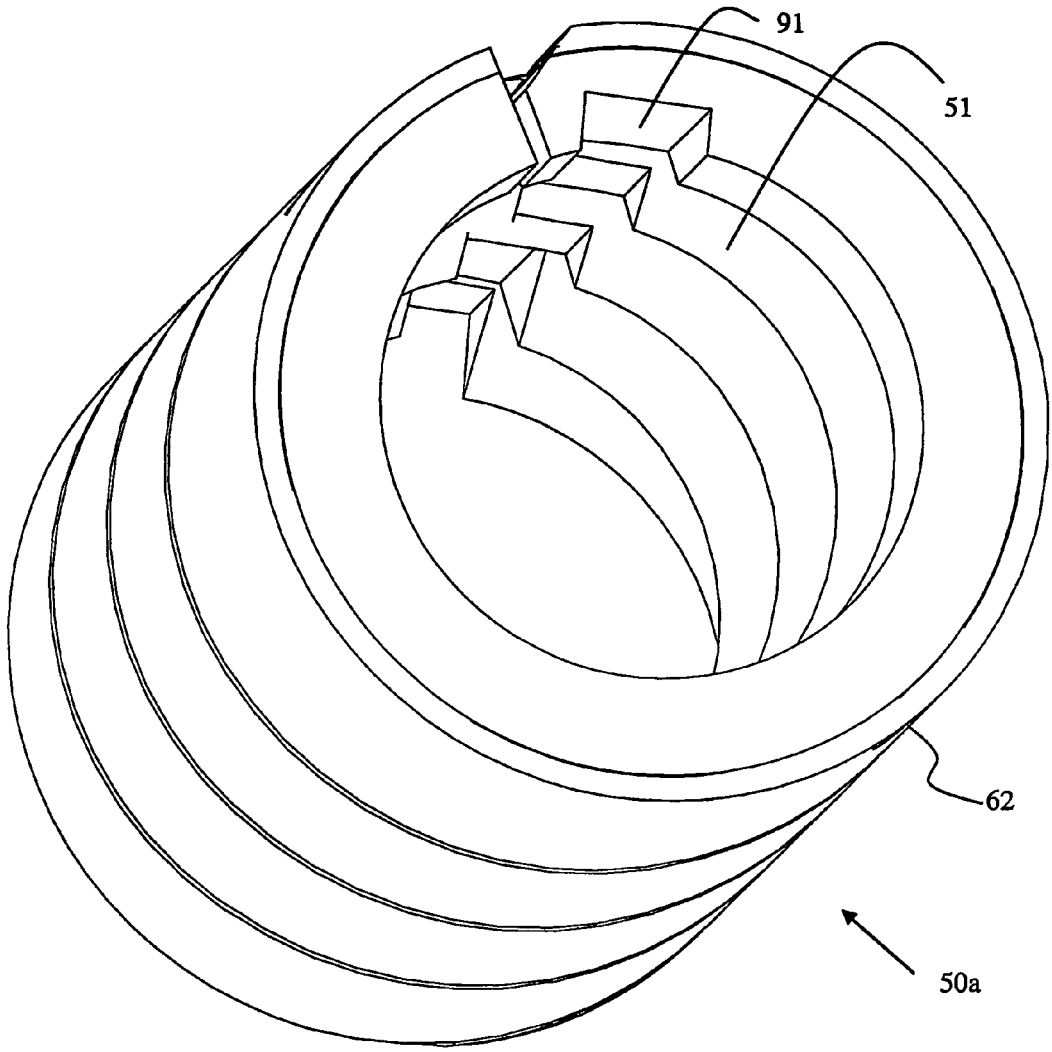
FIG. 7 is a perspective view of an anchor carriage useful with the mandrel of FIG. 6.
Figure 8:
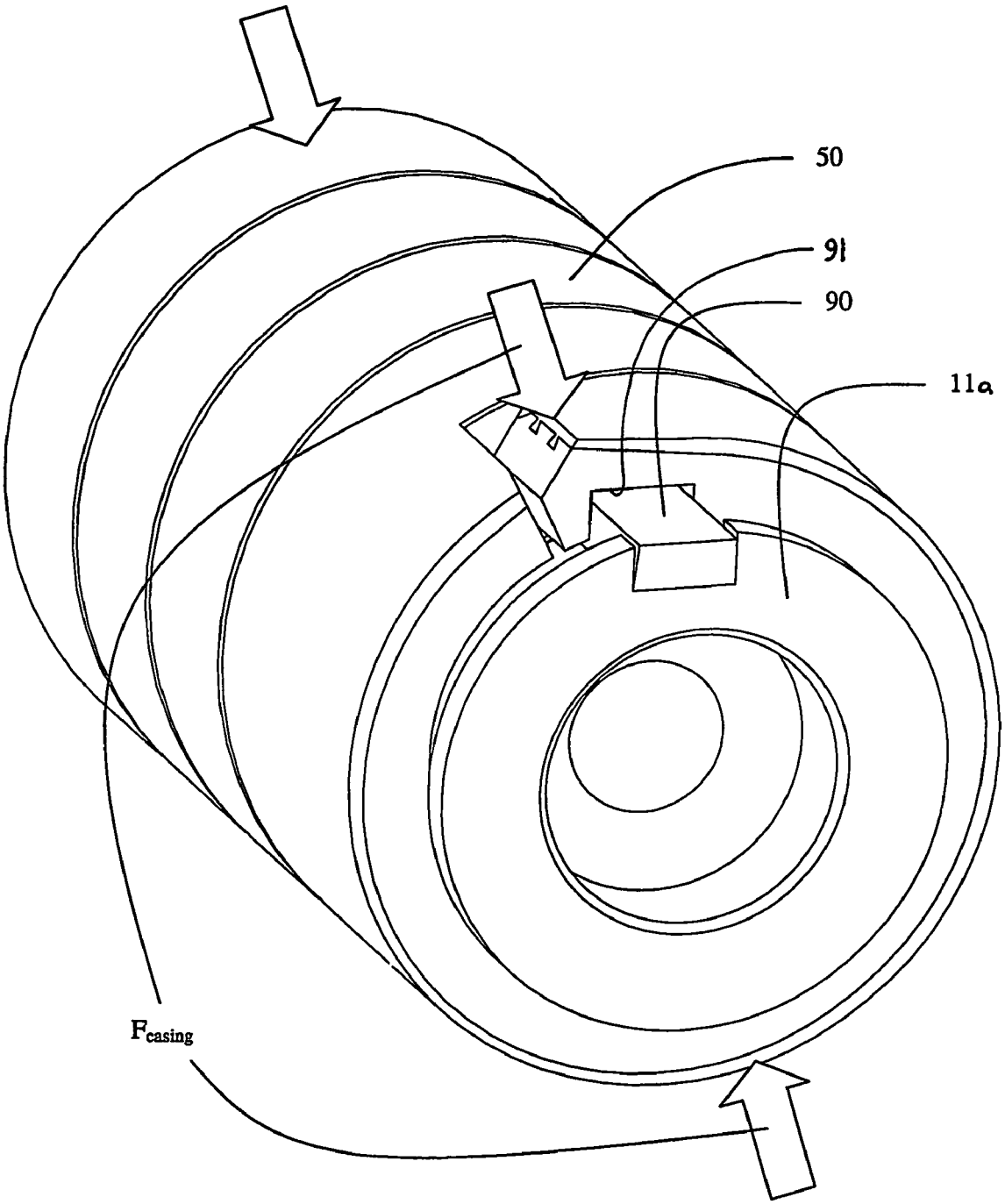
FIG. 8 is a perspective view of the mandrel of FIG. 6 and the anchor carriage of FIG. 7 fit together. It is to be understood that the force of the casing, $F_{casing}$, holds the anchor carriage in this configuration.

FIGS. 6 to 8 show another embodiment of an anchoring device. In the illustrated embodiment, the carriage 50*a* and mandrel 11*a* can be formed such that the carriage can be detachably engaged to the mandrel when the carriage is compressed there against, but can be released from engagement with the mandrel when the carriage is allowed to expand. In the illustrated embodiment, a key 90 can be employed to lock the carriage to the mandrel when the carriage is compressed onto the mandrel for insertion into the casing. This embodiment can maintain the carriage in a compressed condition with an outer diameter less than the casing drift diameter such that the carriage is substantially out of full contact with the casing to reduce the drag produced by the carriage while traversing the casing, for example, when running downhole. This can reduce wear on the outer surface of the anchor carriage and reduce the chance of the tool becoming stuck at locations where the casing inside cross sectional area is reduced or constricted such as at connections. This can also reduce the differential pump down pressure across the upper sealing member, which lower differential pressure in turn tends to reduce wear on the upper sealing member.

Key 90 can be substantially rectangular in cross section and elongate. Key 90 can fit into both a keyway 91 formed through the internal threads 51 of the anchor carriage and a keyway 92 formed through the external threads 29 on the mandrel. Key 90 operates with keyways 91, 92 in a manner analogous to the operation of keying a shaft to, for example, a pulley, preventing relative rotation therebetween. The keyways can be formed to be aligned when the carriage is in its compressed position on the mandrel, as required for running through the casing prior to latching into the profile nipple. The arrows in FIG. 8 show in general where the forces reacted by the casing, $F_{casing}$, ensure that keyway 91 remains engaged to key 90. Keyway 92 in the mandrel is formed to be tight fitting with key 90, so that, once installed, the key tends to stay engaged in the mandrel keyway slot regardless of movement of the carriage thereover. Locking of the key to the mandrel may be further assisted by the use of dovetailing, fasteners, such as screws, or glue. Keyway 91 in the carriage is arranged so that the key fits loosely therein and the depth of keyway 91, with respect to the key exposed height on the mandrel and the anchor carriage thread height, can be arranged so that within the range of radial expansion possible when the carriage is travelling in the casing, keyway 91 engages the key. However, under the greater outward radial expansion allowed when the carriage enters the recess of the profile nipple, keyway 91 will become disengaged from the key over at least its lower length so as to permit the carriage to expand, and thus simultaneously uncoil, along its helical interval. As shown, upper end 93 of the key can have a greater height than the lower end to provide additional engagement between key 90 and keyway 91 adjacent upper C-ring 62. This additional engagement can prevent the carriage threads from becoming disengaged from the key, even when fully expanded into the casing recess. This is useful, in the same way as pin 64, where it is desirable to have torque transfer between the mandrel and the anchor carriage, as when drilling out.

In an embodiment where the anchor carriage includes a helically formed interval, when running mandrel 11*a* and anchor carriage 50*a* into the casing, key 90 can tend to prevent the carriage, acting as a coiled helical spring, from expanding by reacting the forces allowing uncoiling primarily through key 90 and into mandrel 11*a*. At the ends of the helically formed interval, there is an inward radial component to the force required to maintain engagement of that interval with the key. The lower end of keyway 91 in the anchor carriage helically formed interval thus acts as a latch where depending on the angle of contact between the keyway and the contacting lower edge 94 of the key, the latch can be arranged to tend to release, unless restrained by an external radial force as provided by contact with the casing. This angle $\alpha$ can be selected with reference to the in-situ friction coefficient to ensure release when entering the profile nipple but otherwise arranged to minimize the radial force applied by the casing to thus reduce wear and drag and obtain other benefits as described above.

In operation, a tool including an anchoring device can be run into a casing string and latched therein in an annular recess in the casing. In the illustrated embodiments of FIGS. 1 to 3, the tool 10 is illustrated as a cement float including mandrel 11, anchor carriage 50 and seal cups 12 and 13. In its operation tool 10 is placed inside casing 1 and displaced downhole by pumping fluid, typically drilling fluid, through the casing string. Top seal cup 12 tends to prevent flow of the pumping fluid past the cement float tool creating a downward axial force as a function of the applied top differential pressure required to overcome drag where the top seal cup 12, bottom seal cup 13 and anchor carriage 50 contact the casing. In general, the sum of these drag components should not require excess installation pressure. To avoid such excess drag from upper cup seal 12 friction, the wall thickness and length of the seal skirt can be selected in combination with the diameter below the seal land 21 so that under differential pressure loads required to pump down the cement float tool, a clearance can be maintained between the seal lip and internal surface of the casing except at the upper seal land 21 to prevent contact developing outside the seal land while yet providing sufficient compliance to ensure an adequate seal will be formed under the expected variations in internal casing diameter. Drag arising from the bottom seal cup 13 during installation naturally tends to be minimized as this downward facing cup is not loaded under top pressuring required for pump down. Drag arising from the tendency of the elastically compressed anchor carriage to expand against the confining inside diameter of the casing can be affected by frictional interaction between the engaged stab flanks 53' of the coarse threads 51 as the drag load is reacted between anchor carriage 50 and mandrel 11. Selecting too shallow a stab flank angle results in a tendency for the cement float tool to 'jam' during installation. However as more fully described below, this angle also affects the anchor structural behavior. As indicated earlier, the illustrated stab flank angle of approximately 45° (with respect to the cement float tool axis) can be sufficiently steep to prevent jamming. In addition or alternately, excess drag can be avoided by a key 90 and keyway 91 (FIGS. 6 and 7) used to lock the anchor carriage inwardly against the mandrel. In another embodiment other means can be used to hold the anchor carriage in a radially compressed condition, as by ratcheting at the interfacing edges 60*a* of a helical cut section.

Once the cement float tool has been displaced downward to the point where the anchor carriage is latched into the recess 2, application of top pressure produces a downward acting axial load that is transmitted through the mandrel 11 and coarse threads 29, 51 to the anchor carriage, which is pressed outwardly into positive contact with the confining surface of recess 2. Continued axial force on the tool, once it is in the recess, is reacted into the casing at lower shoulder 5. It will be apparent that the interacting mandrel and anchor carriage functions as an anchor so that pressure load sealed across the top seal cup is reacted by the anchor into the casing allowing the releasable plug 80 to be blown out and the flapper valve 70 to function as a check valve during flow of fluids, as required for cementing.

Following placement of the tool, cement can be introduced to the casing string and be displaced into the casing annulus through tool 10 (FIG. 2). If the casing conditions permit, there is a tendency for the heavier cement column in the annulus to 'U-tube' back into the casing. This flow is prevented by the flapper valve 70 with consequent increase of differential bottom pressure across bottom seal cup 13 (FIG. 3). Initial bottom pressure load across the bottom seal cup 13 tends to make it inflate, seal and slide uphole; but this sliding is soon prevented by the interaction of the anchor function of the cement float tool, in an analogous fashion to top pressuring, where the illustrated load flank 53" causes positive radial engagement between the anchor carriage 50 and the recess 2, preventing jump-in of the anchor carriage 50. Unlike the transient top pressure load required to fail and expel releasable plug 80, sealing against bottom differential pressure must be sustained until the cement sets. This may take several hours under typical downhole conditions of elevated temperature and high differential pressure.

The full pressure end load can be borne by the connection between threads 29, 51 for this time period. The materials of the mandrel and the anchor can be selected to address this pressure load.

Alternately or in addition, a lower cup 13 can be used that has a tendency to resist such sliding through a pressure activated self-anchoring mechanism. This self anchoring mechanism is induced under application of differential pressure from below because of the location of the external seal 26 at the lower end of the seal tube 23 in combination with the seepage grooves 28 and 28', which ensures the full pressure differential occurs across the wall of seal tube 23, tending to cause it to expand, contact and become restrained by the profile nipple 3, under application of sufficient pressure. Application of additional pressure serves to increase the interfacial contact stress, which contact stress gives rise to frictional resistance to axial sliding of the seal tube 23. The combination of selecting the lower cup material to be more compliant than the casing and ensuring minimum clearance is maintained between the seal tube and profile nipple 3, as taught herein, promotes contact at lower differential pressure and thus greater resistance to sliding for a given differential pressure. The wall thickness and length of seal tube 23 are arranged to promote self anchoring under application of differential pressure where the wall thickness of seal tube 23 is generally tapered to thicken from its lower end 25 to its upper end 24, and its length can be selected to be long enough to ensure all or a significant amount of the differential pressure end load for the intended application is thus reacted by this self anchoring mechanism. The bottom seal cup can, therefore, function both to seal against bottom pressure and to react the associated end load to assist with anchoring.

It will be apparent that many other changes may be made to the illustrative embodiments, while falling within the scope of the invention and it is intended that all such changes be covered by the claims appended hereto.

The invention claimed is:

1. An anchoring device for use in a pipe, the pipe including an inner diameter with an annular recess formed therein, the annular recess having a length and having a diameter greater than the inner diameter of the pipe, the anchoring device comprising: a mandrel having an outer surface, an upper end and a lower end, the mandrel sized to move through the pipe in which it is to be used; a radially resilient anchor carriage mounted about the mandrel, the anchor carriage defining an inner surface and a substantially cylindrical outer surface, the anchor carriage having a length selected to be less than the pipe annular recess length and being sized to pass through the pipe when radially compressed and to have an outer diameter when radially expanded greater than the pipe inner diameter and interengaging grooves and elongate protrusions formed on the mandrel outer surface and on the anchor carriage inner surface, the interengaging grooves and elongate protrusions of the anchor carriage and the mandrel being selected to limit axial movement of the anchor carriage relative to the mandrel and to permit the anchor carriage to be compressed against the mandrel to fit inside the inner diameter of the pipe and to remain interengaged when the anchor carriage is expanded and latched into the annular recess of the pipe.

2. The anchoring device of claim 1 wherein the mandrel grooves and elongate protrusions include at least some formed as threads.

3. The anchoring device of claim 1 wherein the mandrel grooves and elongate protrusions include at least some formed axi-symmetric and extending circumferentially.

4. The anchoring device of claim 1 wherein the anchor carriage is formed as a composite structure having an outer shell of a first material and inner threads formed of drillable material, attached to the outer shell, the inner threads forming the grooves and elongate protrusions on the inner surface of the anchor carriage.

5. The anchoring device of claim 4 wherein the outer shell thickness is selected not to exceed the depth of the annular recess provided in the pipe.

6. The anchoring device of claim 1 wherein the anchor carriage includes a C-ring portion to provide radial resiliency.

7. The anchoring device of claim 6 where the anchor carriage includes a C-ring at each end and a helically cut spring coil section extending therebetween.

8. The anchoring device of claim 7 wherein the helically cut spring coil section is configured as a right hand helix.

9. The anchoring device of claim 1 wherein the mandrel includes drillable materials.

10. A cement float for use in casing, the casing including an inner diameter with an annular recess formed therein, the annular recess having a length and having a diameter greater than the inner diameter of the casing, the cement float comprising: a mandrel having an outer surface, an upper end, a lower end and an axial bore extending from its upper end to its lower end, the mandrel sized to move through the casing in which it is to be used; a radially resilient anchor carriage mounted about the mandrel, the anchor carriage defining a substantially cylindrical outer surface and an inner surface, the anchor carriage having a length selected to be less than the casing annular recess length and being sized to pass through the casing when radially compressed and having an outer diameter when radially expanded greater than the casing inner diameter, interengaging grooves and elongate protrusions on the anchor carriage inner surface and on the mandrel outer surface selected to limit axial movement of the anchor carriage relative to the mandrel and to permit the anchor carriage to be compressed against the mandrel to fit inside the inner diameter of the casing and to remain interengaged when the anchor carriage is expanded and latched into the annular recess of the casing; a one way valve in mandrel axial bore; and a seal about the mandrel for sealing between the mandrel and the casing.

11. The cement float of claim 10 wherein the mandrel grooves and elongate protrusions include at least some formed as threads.

12. The cement float of claim 10 wherein the mandrel grooves and elongate protrusions include at least some formed axi-symmetric and extending circumferentially.

13. The cement float of claim 10 wherein the anchor carriage is formed as a composite structure having an outer shell of a first material and coarse threads formed of drillable material, attached to the outer shell, the coarse threads forming the grooves and elongate protrusions on the inner surface of the anchor carriage.

14. The cement float of claim 13 wherein the outer shell thickness is selected not to exceed the depth of the annular recess provided in the casing.

15. The cement float claim 10 wherein the anchor carriage includes a C-ring portion to provide radial resiliency.

16. The cement float of claim 15 where the anchor carriage includes a C-ring at each end and a helically cut spring coil section extending therebetween.

17. The cement float of claim 16 wherein the helically cut spring coil section is configured as a right hand helix.

18. The cement float of claim 10 wherein the anchor carriage outer diameter, when radially expanded is greater than the annular recess diameter.

* * * * *